US006931761B2

(12) United States Patent
Hwang

(10) Patent No.: US 6,931,761 B2
(45) Date of Patent: Aug. 23, 2005

(54) LAUNDRY DRYER

(75) Inventor: Sung Gi Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/724,355

(22) Filed: Dec. 1, 2003

(65) Prior Publication Data

US 2004/0159009 A1 Aug. 19, 2004

(30) Foreign Application Priority Data

Dec. 2, 2002 (KR) ..... 10-2002-0075982

(51) Int. Cl.[7] ..... F26B 11/02
(52) U.S. Cl. ..... 34/601; 34/603
(58) Field of Search ..... 34/601, 602, 603; 68/139, 140

(56) References Cited

U.S. PATENT DOCUMENTS 5,860,300 A * 1/1999 Valent ..... 68/24
6,256,823 B1 * 7/2001 Kronbetter et al. ..... 8/158
6,474,351 B1 * 11/2002 Cerruti et al. ..... 134/99.2
6,761,049 B2 * 7/2004 Nitschmann et al. ..... 68/5 E

* cited by examiner

*Primary Examiner*—Denise L. Esquivel
*Assistant Examiner*—Kathryn S. O'Malley
(74) *Attorney, Agent, or Firm*—Fleshner & Kim LLP

(57) ABSTRACT

An entrance sealing assembly for a hinged door of a laundry dryer provides a complete sealing of all gaps between the essential components of the entrance sealing assembly. The laundry dryer includes a door frame, the door frame being provided with a door glass; a frame cover having a frame cover panel in which an entrance hole is formed for receiving the door frame, the frame cover panel having an inner end surface; a front support, coupled with the frame cover, for supporting a drum, the front support having an inner end surface; and a unified sealing member having first and second ends, disposed between the frame cover and the front support, the second end of the unified sealing member providing for contact with the door glass when the hinged door is closed.

17 Claims, 3 Drawing Sheets

LAUNDRY DRYER

This application claims the benefit of Korean Application No. 10-2002-0075982 filed on Dec. 2, 2002, which is hereby incorporated by reference.

BACKGROUND OF THE INVENTION

1. Field of the Invention

The present invention relates to a laundry dryer, and more particularly, to a laundry dryer employing a unified sealing means in an entrance sealing assembly of the laundry dryer.

2. Discussion of the Related Art

Generally speaking, a laundry dryer performs the drying of laundry using hot air circulating within a sealed space, which is in essence a drum having an entrance provided with a hinged door for accessing the drum. Typically, the door is provided with a glass window for observing the status of the drum's interior. During drying, hot and humid air is contained under an airtight seal between the various components of the laundry dryer, including the door, the glass window of the door, and components forming the front surface of the drum. Such a laundry dryer is illustrated in FIG. 1.

Referring to FIG. 1, a laundry dryer comprises a cabinet frame 11 forming the body of the laundry dryer and a frame cover 14 forming the front surface of the cabinet and having an entrance hole where a door frame 15 is installed. The door frame 15 has a door glass 15*a* through which a user can observe the state of drying. A drum 20 is mounted within the cabinet frame 11, and the front side of the drum is secured to the frame cover 14 using a front support 22 coupled to the frame cover.

During operation, the air circulating within the closed space, formed by the door frame 15 and door glass 15*a* closing the entrance hole of the frame cover 14 connected to the front support 22, may escape through gaps between the above-mentioned components of the laundry dryer. Accordingly, a laundry dryer according to a related art is provided with a door sealing assembly, as shown in FIG. 2.

Referring to FIG. 2, a door sealing assembly is provided three separate seals or gaskets for establishing an airtight seal between respective components, namely, a first sealing member 41 for sealing a gap between the door frame 15 and door glass 15*a*, a second sealing member 42 for sealing a gap between the door frame 15 and a frame cover panel 14*a* of the frame cover 14, and a third sealing member 43 for sealing a gap between the frame cover panel and a front support panel 22*a* of the front support 22. In doing so, however, three distinctly shaped sealing members are required, which complicates fabrication and increases production costs accordingly. Moreover, with the use of multiple sealing members, there is an inherent increase in the probability of a leak to occur.

SUMMARY OF THE INVENTION

Accordingly, the present invention is directed to a laundry dryer that substantially obviates one or more of the problems due to limitations and disadvantages of the related art.

An object of the present invention, which has been devised to solve the foregoing problem, lies in providing a laundry dryer, by which the sealing properties of an entrance sealing assembly are improved while simplifying fabrication and reducing production cost.

It is another object of the present invention to provide a laundry dryer having an entrance sealing assembly in which a unified sealing member is used to perform the necessary sealing actions.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry dryer having an entrance sealing assembly for a hinged door. The laundry dryer comprises a door frame, the door frame being provided with a door glass; a frame cover having a frame cover panel in which an entrance hole is formed for receiving the door frame, the frame cover panel having an inner end surface; a front support, coupled with the frame cover, for supporting a drum, the front support having an inner end surface; and a unified sealing member having first and second ends, disposed between the frame cover and the front support, the second end of the unified sealing member providing for contact with the door glass when the hinged door is closed.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings.

Figure 1:
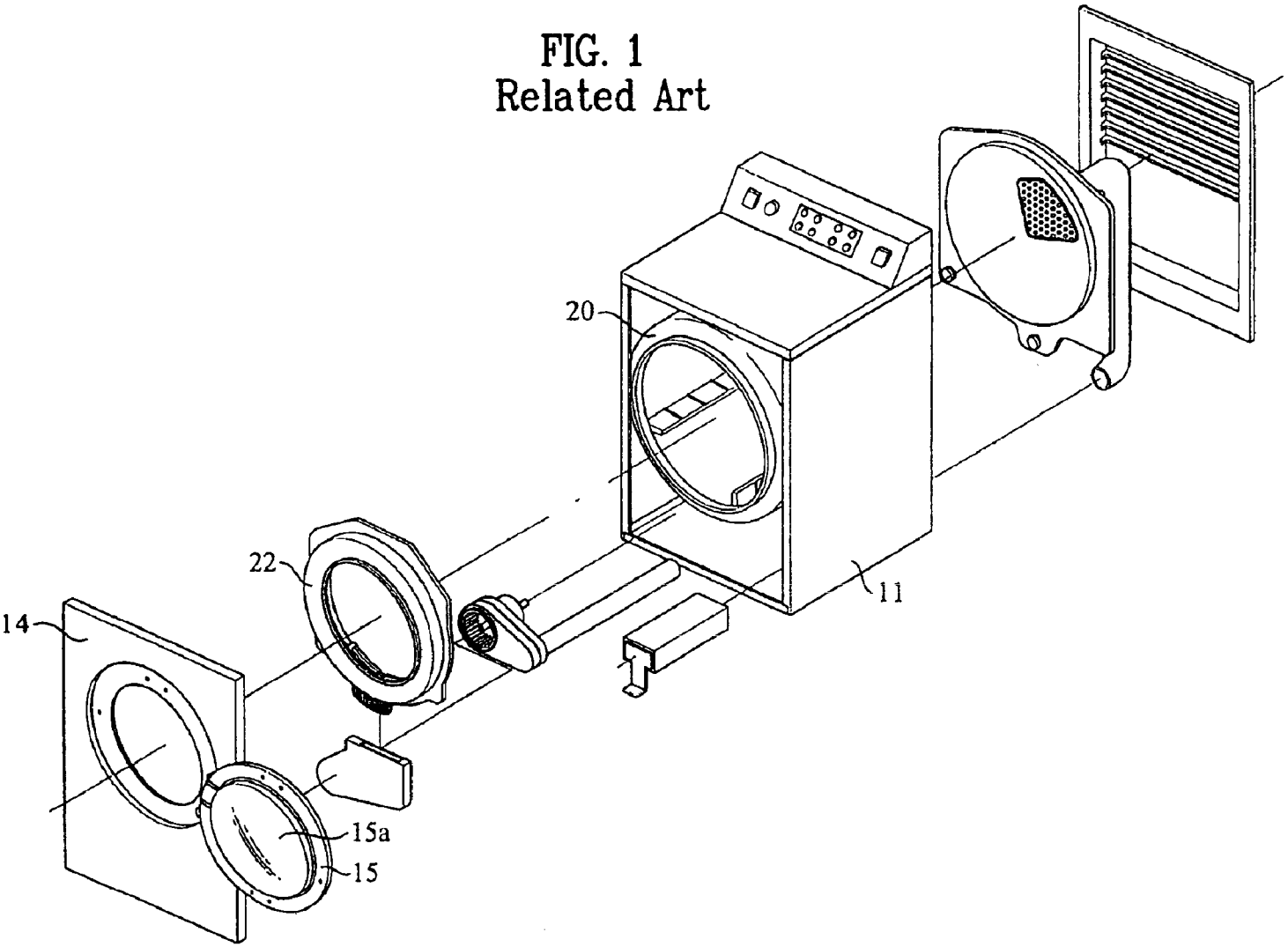
FIG. 1 Related Art
FIG. 1 is an exploded perspective view of a general laundry dryer.
Figure 3:
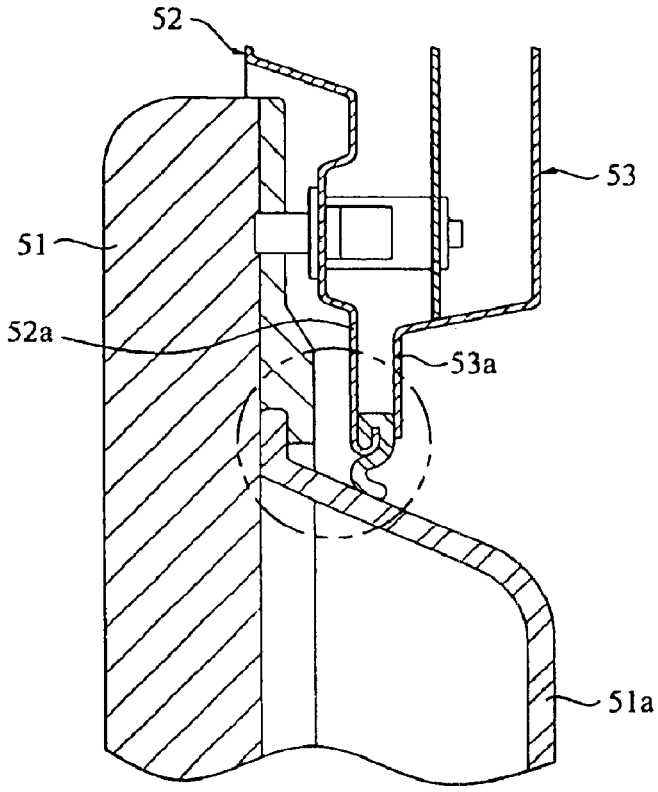
FIG. 3 is a cross-sectional view of an entrance sealing assembly of a laundry dryer according to the present invention.

Referring to FIG. 3, a laundry dryer according to the present invention is provided with a frame cover 52 having a frame cover panel 52*a* having a rolled inner end 52*b*, a door frame 51 with a door glass 51*a*, a front support 53 having a front support panel 53*a*, a unified sealing member 54, and a fixing bar 55. The frame cover 52, which provides the front cover of the cabinet frame (shown in FIG. 1) and is coupled to the front support 53, has an entrance hole for receiving the door frame 51 with the door glass 51*a* through which a user may observe the state of drying. The front support 53 provides support for the front end of the drum (shown in FIG. 1) to be mounted to the frame cover 52. The unified sealing member 54 is a single gasket piece, disposed between inner end surfaces of the frame cover panel 52*a* of the frame cover 52 and the front support panel 53*a* of the front support 53, for sealing a gap between the frame cover and the support cover. One end of the unified sealing member 54 is installed between the inner end surfaces of the frame cover panel 52*a* and support cover panel 53*a*, and the other end provides for contact with the door glass 51*a*.

Figure 4:
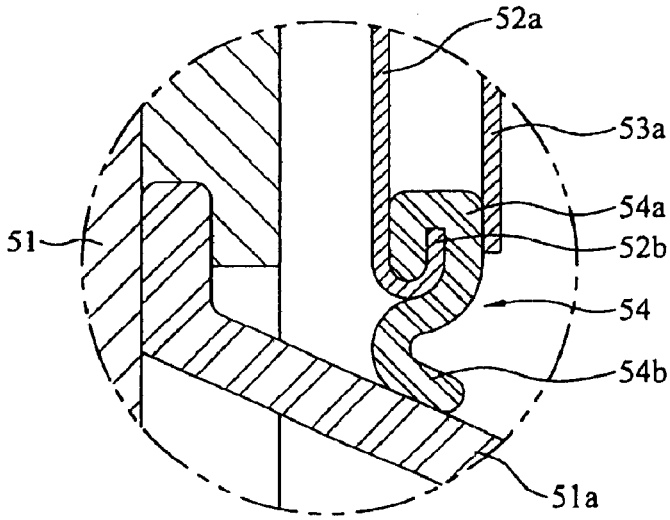
FIG. 4 is a cross-sectional view of the sealing member of FIG. 3.

Referring to FIG. 4, the unified sealing member 54 comprises a head portion 54*a*, installed between the inner end surfaces of the frame cover panel 52*a* and support cover panel 53*a*, for sealing the gap between the frame cover 52 and the front support 53; and a tail portion 54*b*, opposite the head portion, for sealing the gap between the door glass 51*a* and the frame cover by being brought into contact with the door glass when the door of the laundry dryer is closed. The head portion 54*a* is formed to be partially inserted in a hooked inner end 52*b* of the frame cover panel 52*a*, which is bent back toward the support frame panel 53*a*. The tail portion 54*b* of the sealing member 54 is pliant so as to be deformed over a predetermined length to establish a planar contact with the door glass 51*a*, thus sealing the gap between the door glass and the frame cover 52 when the door frame 51 is in a closed position.

Figure 2:
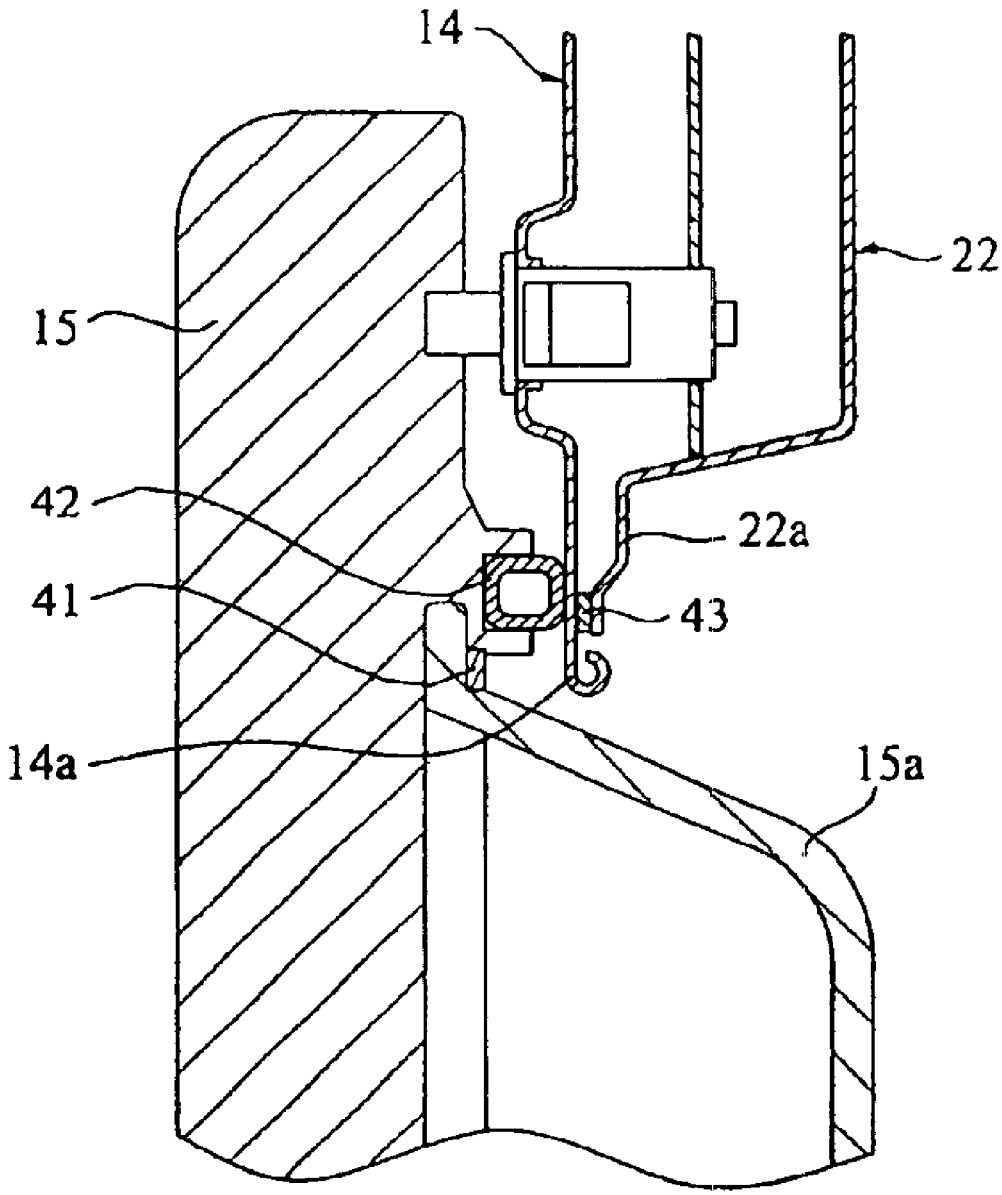
FIG. 2 Related Art
FIG. 2 is a cross-sectional view of an entrance sealing assembly of a laundry dryer according to a related art.

The unified sealing member 54, as the essential element of an entrance sealing assembly of a hinged door of a laundry dryer, provides an airtight seal to a plurality of gaps between various components of a laundry dryer adopting the entrance sealing assembly of the present invention. These gaps include those sealed by the sealing member of the related art as described with reference to FIGS. 1 and 2, namely, the gap between the door frame 51 and door glass 51*a*, the gap between the door frame and frame cover 52, and the gap between the frame cover 52 and front support 53. The gap between the frame cover 52 and front support 53 is sealed by the head portion 54*a* of the unified sealing member 54, which is inserted in the hooked inner end 52*b* of the frame cover panel 52*a* to increase the sealing effect. With the closing of the door, the tail portion 54*b* of the unified sealing means 54 seals the gap between the frame cover 52 and the door glass 51*a*, rendering unnecessary any additionally sealing of gaps between the door glass and the door frame 51, between the door frame and the frame cover, and between the door frame and the front support 53. In other words, a complete sealing of all gaps between the essential components of the entrance sealing assembly of a laundry dryer adopting the present invention is achieved by the unified sealing member 54, one end of which is installed between the inner end surfaces of the frame cover panel 52*a* and the support cover panel 53*a* such that the other end, i.e., the tail portion, is brought into contact with the door glass 51*a* by a closing of the door. Accordingly, the reduced number of sealing members improves the sealing properties of the door sealing assembly, simplifies fabrication, and reduces production cost.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry dryer having an entrance sealing assembly for a hinged door, the laundry dryer comprising:

a door frame, said door frame being provided with a door glass;

a frame cover having a frame cover panel in which an entrance hole is formed for receiving said door frame, the frame cover panel having an inner end surface;

a front support, coupled with said frame cover, for supporting a drum, the front support having an inner end surface; and a unified sealing member having first and second ends, disposed between said frame cover and said front support, the second end of said unified sealing member contacting the door glass when the hinged door is closed.

2. The laundry dryer as claimed in claim 1, said unified sealing member comprising:

a head portion, formed at the first end to be installed between the inner end surfaces of the frame cover panel of said frame cover and the support covet panel of said front support, for sealing a first gap between said frame cover and said front support; and a tail portion, formed at the second end to protrude from the sealed first gap, for sealing a second gap between the door glass and said frame cover by being brought into contact with the door glass when the hinged door is closed.

3. The laundry dryer as claimed in claim 2, wherein the frame cover panel of said frame cover has a hooked inner end for receiving said head portion.

4. The laundry dryer as claimed in claim 2, wherein said tail portion is deformed over a predetermined length to establish a planar contact with the door glass when the hinged door is closed.

5. The laundry dryer as claimed in claim 2, wherein the sealing of the second gap seals a third gap between the door glass and said door frame.

6. The laundry dryer as claimed in claim 2, wherein the sealing of the second gap seals a fourth gap between said door frame and said frame cover.

7. The laundry dryer as claimed in claim 2, wherein the sealing of the second gap seals a fifth gap between said door frame and said front support.

8. A laundry dryer having an entrance sealing assembly for a hinged door, the laundry dryer comprising:

a door frame, said door frame being provided with a door;

a frame cover in which an entrance hole is formed for receiving said door frame, the frame cover having an inner end surface;

a support, coupled with said frame cover, for supporting a drum, the support having an inner end surface; and a unified sealing member having first and second ends, clamped between said frame cover and said support, and configured to seal a first gap between said frame cover and said support.

9. The laundry dryer as claimed in claim 8, wherein the door comprises glass.

10. The laundry dryer as claimed in claim 8, said unified sealing member comprising:

a head portion, formed at the first end to be installed between the inner end surfaces of a frame cover panel of said frame cover and a support cover panel of said support, for sealing the first gap between said frame cover and said support; and a tail portion, formed at the second end to protrude from the sealed first gap, for sealing a second gap between the door and said frame cover by being brought into contact with the door when the hinged door is closed.

11. The laundry dryer as claimed in claim 10, wherein the frame cover panel of said frame cover has a hooked inner end for receiving said head portion.

12. The laundry dryer as claimed in claim 10, wherein said tail portion is deformed over a predetermined length to establish a planar contact with the door when the hinged door is closed.

13. A laundry dryer having an entrance sealing assembly for a hinged door, the laundry dryer comprising:

a door frame, said door frame being provided with a door;

a frame cover in which an entrance hole is formed for receiving said door frame, the frame cover having an inner end surface;

a support, coupled with said frame cover, for supporting a drum, the support having an inner end surface; and a unified sealing member having first and second ends, wherein the first end is configured to be clamped between said frame cover and said support, and the second end is configured to make contact with only the door when the hinged door is closed.

14. The laundry dryer as claimed in claim 13, wherein the door comprises glass.

15. The laundry dryer as claimed in claim 13, said unified sealing member comprising:

a head portion, formed at the first end to be installed between the inner end surfaces of a frame cover panel of said frame cover and a support cover panel of said support, for sealing a first gap between said frame cover and said support; and a tail portion, formed at the second end to protrude from the sealed first gap, for sealing a second gap between the door and said frame cover by being brought into contact with the door when the hinged door is closed.

16. The laundry dryer as claimed in claim 15, wherein the frame cover panel of said frame cover has a hooked inner end for receiving said head portion.

17. The laundry dryer as claimed in claim 15, wherein said tail portion is deformed over a predetermined length to establish a planar contact with the door when the hinged door is closed.

* * * * *